US011619126B2

(12) United States Patent
Ruhle et al.

(10) Patent No.: US 11,619,126 B2
(45) Date of Patent: Apr. 4, 2023

(54) ESTIMATE ACTIVE-ADJACENT BOREHOLE INTERFERENCE SEVERITY

(71) Applicant: Halliburton Energy Services, Inc., Houston, TX (US)

(72) Inventors: William Owen Alexander Ruhle, Denver, CO (US); Dinesh Ananda Shetty, Sugar Land, TX (US); Srividhya Sridhar, Bellaire, TX (US); Shahab Jamali, Spring, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 105 days.

(21) Appl. No.: 17/112,600

(22) Filed: Dec. 4, 2020

(65) Prior Publication Data

US 2022/0178250 A1 Jun. 9, 2022

(51) Int. Cl.
*E21B 47/117* (2012.01)
*E21B 47/06* (2012.01)
*E21B 43/26* (2006.01)

(52) U.S. Cl.
CPC ..... *E21B 47/117* (2020.05); *E21B 43/26* (2013.01); *E21B 47/06* (2013.01); *E21B 2200/20* (2020.05)

(58) Field of Classification Search
CPC ..... E21B 47/117; E21B 47/06; E21B 2200/20
See application file for complete search history.

(56) References Cited

U.S. PATENT DOCUMENTS

| | | | | |
|---|---|---|---|---|
| 8,078,328 | B2 | 12/2011 | Malki et al. | |
| 9,500,076 | B2 * | 11/2016 | Walters | E21B 43/26 |
| 10,494,918 | B2 * | 12/2019 | Coenen | G06F 30/20 |
| 2014/0262232 | A1 | 9/2014 | Dusterhoft et al. | |
| 2019/0346579 | A1 | 11/2019 | Roussel et al. | |

FOREIGN PATENT DOCUMENTS

WO 2016091972 A1 6/2016

OTHER PUBLICATIONS

Sardinha, et al.; "Determining Interwell Connectivity and Reservoir Complexity Through Frac Pressure Hits and Production Interference Analysis"; SPE International; SPE-171628-MS; SPE/CSUR Unconventional Resources Conference; Sep. 30-Oct. 2, 2014; 15 pgs.

(Continued)

*Primary Examiner* — Catherine Loikith
(74) *Attorney, Agent, or Firm* — John Wustenberg; Parker Justiss, P.C.

(57) ABSTRACT

A process to determine whether a leak-off event is occurring during the treatment stage of an active borehole. The leak-off event data, such as the severity or magnitude of the potential leak-off, can be communicated to other systems to adjust the treatment stage, the fluid composition, the fluid pressure, or the fluid flow rate. Diverter material can be added to the fluid. The monitoring of the leak-off event can occur over a time interval, such as the time of the treatment stage and periodic adjustments to the treatment stage can be implemented. The leak-off event can be identified when a fluid pressure slope indicates an overall increase in pressure in an adjacent borehole or if the amount of fluid entering an adjacent borehole exceeds a leak-off threshold.

20 Claims, 4 Drawing Sheets

(56) References Cited

OTHER PUBLICATIONS

Shokri, et al.; "Constraining the Complexity of Stimulated Reservoir Volume during Multi-Stage Hydraulic Fracturing of Horizontal Wells through Inter-Well Pressure Hit Modeling"; SPE International; SPE-187188-MS; SPE Annual Technical Conference and Exhibition; Oct. 9-11, 2017; 24 pgs.
Rainbolt, et al.; "Frac Hit Induced Production Losses: Evaluating Root Causes, Damage Location, Possible Prevention Methods and Success of Remediation Treatments, Part II"; SPE International; SPE-189853-MS; SPE Hydraulic Fracturing Technology Coference & Exhibition; Jan. 23-25, 2018; 23 pgs.
Das, et al; "Child Well Analysis from Poroelastic Pressure Responses on Parent Wells in the Eagle Ford"; SPE International; SPE-194354-MS; SPE Hydraulic Fracturing Technology Conference and Exhibition; Feb. 5-7, 2019; 14 pgs.
Cotrell, et al.; "Making Frac Hits History with Computational Physics"; URTeC: 332; Unconventional Resources Technology Conference; Jul. 22-24, 2019; 15 pgs.

* cited by examiner

ESTIMATE ACTIVE-ADJACENT BOREHOLE INTERFERENCE SEVERITY

TECHNICAL FIELD

This application is directed, in general, to determining a hydraulic fracturing treatment stage plan and, more specifically, to determining a magnitude of a leak-off event.

BACKGROUND

When developing a well system, fluid is often pumped into the well system as part of a treatment plan. For example, the fluid can be a fracturing fluid in a hydraulic fracturing well system. When this is done near a void, such as an adjacent borehole or a depleted reservoir, some of the hydraulic fluid can leak off into that other void. This can be detected because the volume of fluid that is pumped into the borehole is larger than what the borehole can hold. As fluid leaks off into the void, the efficiency of the fluid in the active well system decreases, for example, the fluid pressure can drop. Understanding the amount or magnitude of leak-off that is occurring would be beneficial.

SUMMARY

In one aspect, a method is disclosed. In one embodiment, the method includes (1) receiving input parameters from one or more adjacent boreholes in a reservoir, (2) performing a treatment stage of an active borehole proximate the one or more adjacent boreholes, (3) monitoring the input parameters of the one or more adjacent boreholes, wherein the input parameters are received at a periodic time interval, and (4) determining a leak-off event with one or more of the one or more adjacent boreholes by utilizing one or more of monitoring a change in an adjacent fluid pressure or an adjacent fluid volume of the one or more of the one or more adjacent boreholes, wherein the adjacent fluid pressure exceeds a fracture hit threshold or the adjacent fluid volume exceeds a leak-off threshold.

In a second aspect, a system that includes an active borehole of a reservoir undergoing at least one treatment stage where pumped fluid is pumped into the active borehole is disclosed. In one embodiment, the system includes (1) a well site controller, capable of directing operation of the active borehole and directing an adjustment of the pumped fluid, and where the reservoir includes at least one adjacent borehole, and (2) a leak-off event estimator, capable of receiving input parameters from the at least one adjacent borehole and the well site controller at a periodic time interval, and determining a leak-off event, wherein the leak-off event is determined using a fracture hit threshold or a leak-off threshold.

In a third aspect, a computer program product having a series of operating instructions stored on a non-transitory computer-readable medium that directs a data processing apparatus when executed thereby to perform operations to determine a leak-off event is disclosed. In one embodiment, the computer program product has operations including (1) receiving input parameters from one or more adjacent boreholes in a reservoir, (2) directing a treatment stage of an active borehole proximate the one or more adjacent boreholes, (3) monitoring the input parameters of the one or more adjacent boreholes, wherein the input parameters are received at a periodic time interval, and (4) determining a leak-off event with one or more of the one or more adjacent boreholes by utilizing one or more of monitoring a change in an adjacent fluid pressure or an adjacent fluid volume of the one or more of the one or more adjacent boreholes, wherein the adjacent fluid pressure exceeds a fracture hit threshold or the adjacent fluid volume exceeds a leak-off threshold.

BRIEF DESCRIPTION

Reference is now made to the following descriptions taken in conjunction with the accompanying drawings, in which.

DETAILED DESCRIPTION

Figure 1:
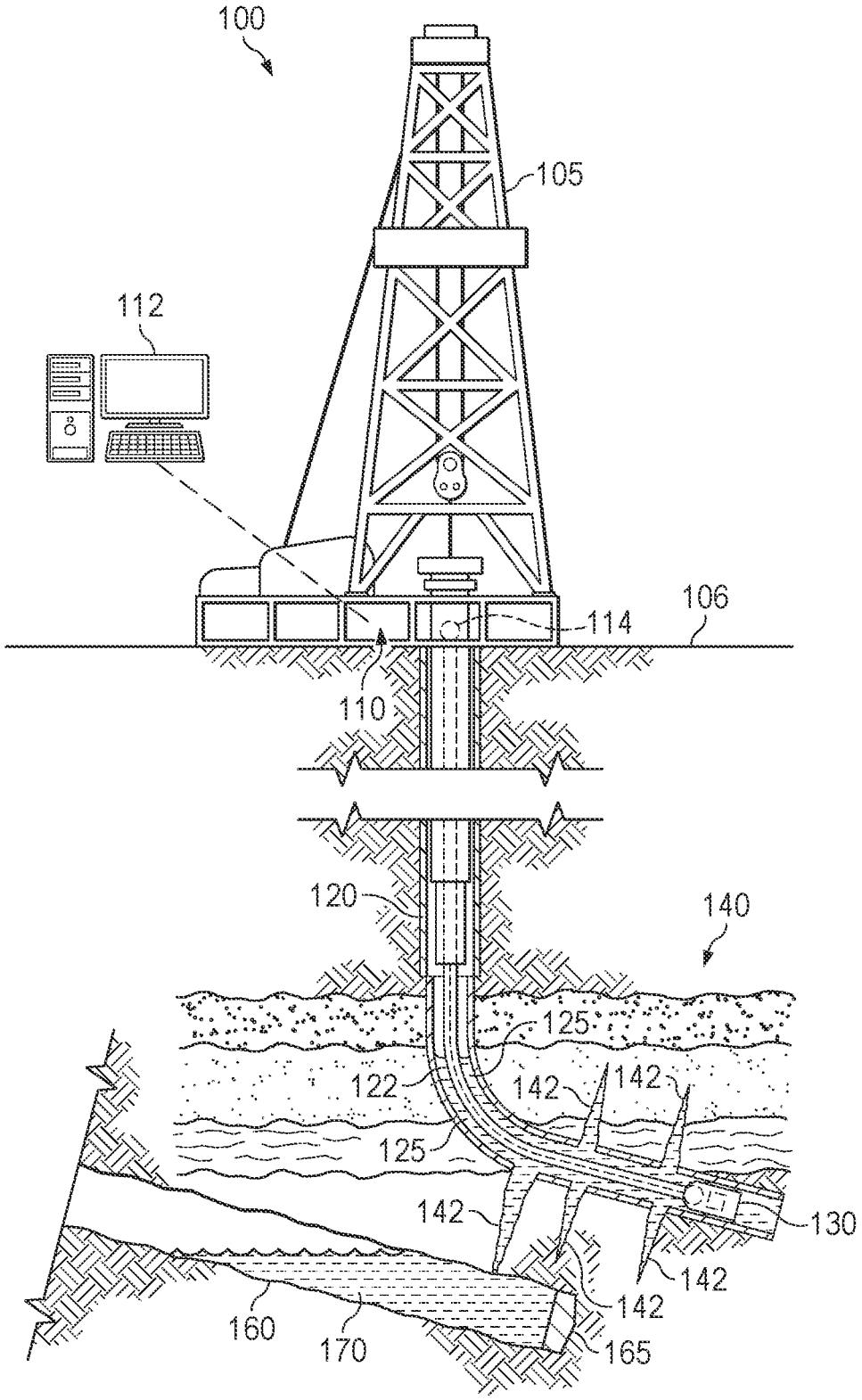
FIG. 1 is an illustration of a diagram of an example hydraulic fracturing (HF) well system.

When developing a borehole system, such as a hydraulic fracturing (HF) well system, a scientific borehole system, or other types of borehole systems, a treatment plan can include a stage for pumping a fluid into the active borehole. The fluid can be one or more, or a combination of, various types of fluids, for example, oil, water, brine, chemicals, diverters, hydraulic fluids, slurry, proppant, and other fluids with various additives. The fluid pumped into a borehole location, e.g., downhole material, can perform a function to develop the borehole, for example, fracturing a portion of the surrounding subterranean formation or blocking a fluid path with diverter material.

During the treatment stage, the ability to place a maximum possible amount of fluid, for example, proppant or slurry, in the borehole system, e.g., reservoir, can be important for the efficiency of the treatment stage. Presence of a depleted reservoir adjacent to the active borehole, e.g., adjacent borehole, void, reservoir, or other subterranean formation area (collectively, adjacent borehole system), can result in well-interference, and hence loss of the fluid to the depleted reservoir, e.g., a leak-off event.

The effectiveness of the pumped fluid performing its function can be reduced if a portion of the pumped fluid leaks off into another void. Understanding the amount or magnitude of the leak-off can improve decision making by a controller, such as a well site controller or a user. Decisions can be made to adjust the pressure, volume, or rate of the pumped fluid, or diverter material can be increased or decreased in the pumped fluid. Being able to determine these decisions can improve the efficiency of developing the borehole and thereby reduce operating costs.

This disclosure presents processes that can be implemented to determine the amount or magnitude of a potential leak-off event in real-time or near real-time. The disclosed processes can be implemented by one or more computing systems capable of receiving input parameters, performing the described calculations, and outputting the result parameters to a controller, a computing system, or a user. The computing system can be a well site controller, a smartphone, mobile phone, PDA, laptop, server, data center, cloud environment, and can be located proximate the active borehole or a distance from the active borehole. In some aspects, the input parameters can be the fluid volume and the fluid pressure measurements over a time interval for the adjacent boreholes. In some aspects, the input parameters can include adjacent borehole system characteristics, reservoir characteristics, and subterranean formation characteristics. In some aspects, the active borehole pressure can be measured at a surface location. In some aspects, the processes can be applied to pressure measurements measured at one or more locations within the active borehole.

As a decision is made utilizing the leak-off event data, adjustments to the pumped fluid parameters can be made, for example, an adjustment to the pump volume, the pump rate, or the pump pressure. In addition, the fluid composition can be adjusted, for example, adding diverter material, adjusting the amount of diverter material, or adjusting the composition of the pumped fluid, such as adjusting the amount of oil, water, brine, chemicals, additives, proppant, slurry, or other hydraulic fluids.

As the pumped fluid parameters or composition are adjusted, the disclosed processes can recalculate the estimated leak-off event data in real-time or near real-time so a controller or a user can monitor the effectiveness of the adjustments made and determine whether further adjustments should be made to the pumped fluid parameters or composition. The described processes can improve the efficiency of developing the borehole, e.g., well system, thereby lowering operating costs.

In some aspects, a real-time or near real-time recording of pressure fluctuations on one or more parent wells, e.g., adjacent boreholes, during the treatment stage of an active well, translated into fluid volume invading the depleted reservoir boundary, e.g., misplaced slurry, can be utilized to quantify the severity of interference on the active borehole by the one or more adjacent borehole systems, to enable deployment of control techniques to mitigate the severity.

Turning now to the figures, FIG. 1 is an illustration of a diagram of an example HF well system 100, which can be a well site where HF operations are occurring through the implementation of a HF treatment plan. HF well system 100 demonstrates a nearly horizontal borehole undergoing a fracturing operation. Although FIG. 1 depicts a specific borehole configuration, those skilled in the art will understand that the disclosure is equally well suited for use in boreholes having other orientations including vertical boreholes, horizontal boreholes, slanted boreholes, multilateral boreholes, and other borehole types. FIG. 1 depicts an onshore operation. Those skilled in the art will understand that the disclosure is equally well suited for use in offshore operations. FIG. 1 depicts a HF well system and the disclosed processes can be utilized for other borehole types, for example, scientific boreholes, drilling boreholes, and other type of boreholes and well systems.

HF well system 100 includes a surface well equipment 105 located at a surface 106, a well site controller 110, and a HF pump system 114. In some aspects, well site controller 110 is communicatively connected to a computing system 112, for example, a server, a data center, a cloud service, a tablet, a laptop, a smartphone, or other types of computing systems. Computing system 112 can be located proximate to well site controller 110 or located a distance from well site controller 110. Computing system 112 can be utilized by a well system engineer or operator to review leak-off event data or to direct recommendations to a pumping plan generator or well site controller 110.

Extending below surface 106 from surface well equipment 105 is a borehole 120. Borehole 120 can have zero or more cased sections and a bottom section that is uncased. Inserted into the borehole 120 is a fluid pipe 122. The bottom portion of fluid pipe 122 has the capability of releasing pumped fluid 125 from fluid pipe 122 to the surrounding subterranean formation 140. The release of pumped fluid 125 can be by perforations in fluid pipe 122, by valves placed along fluid pipe 122, or by other release means. At the end of fluid pipe 122 is a bottom hole assembly (BHA) 130. BHA 130 can be one or more downhole tools, including an endcap assembly. Proximate borehole 120 is an adjacent borehole 160 that has an endcap 165. For demonstration purposes, fluid 170 is shown as having leaked into borehole 160 from borehole 120 through one of the fracture clusters 142.

In HF well system 100, fluid pipe 122 is releasing pumped fluid 125 into subterranean formation 140 at a determined HF fluid pressure and HF fluid flow rate. Pumped fluid 125 is being absorbed by, e.g., enter or flowing into, several fracture clusters 142. The leak-off event data computed can be utilized as an input into a pumping plan for HF well system 100, such as for the pumping plan of the treatment stage. The insights gained from the leak-off computation result parameters can be used by well site controller 110 or computing system 112 to modify the treatment stage, such as adjusting the concentration or composition of pumped fluid 125, adjusting the timing of release of diverter material or other downhole material, or adjusting the HF fluid pressure, HF fluid flow rate, or HF fluid volume of pumped fluid 125.

Well site controller 110 can include a well site parameter collector that can collect sensor data from sensors proximate to the well site and located within the borehole, such as a downhole HF fluid pressure gauge and a DAS. In some aspects, well site controller 110 and computing system 112 can include a leak-off estimator system capable of receiving downhole data, such as HF fluid pressure, HF fluid flow rate, physical model parameters, borehole parameters, input parameters from adjacent boreholes, and other data, and compute the leak-off event data.

In an alternative aspect, computing system 112 can be located a distance from HF well system 100, such as in a data center, server, or other system, and computing system 112 can be disconnected from HF well system 100. In this aspect, computing system 112 can receive physical model parameters, along with the borehole parameters, treatment stage parameters, and other input parameters, where the various parameters were collected by the other components of HF well system 100. In some aspects, the leak-off event estimator can be part of computing system 112 and can produce a recommendation on the modifications to the treatment stage.

Figure 2:
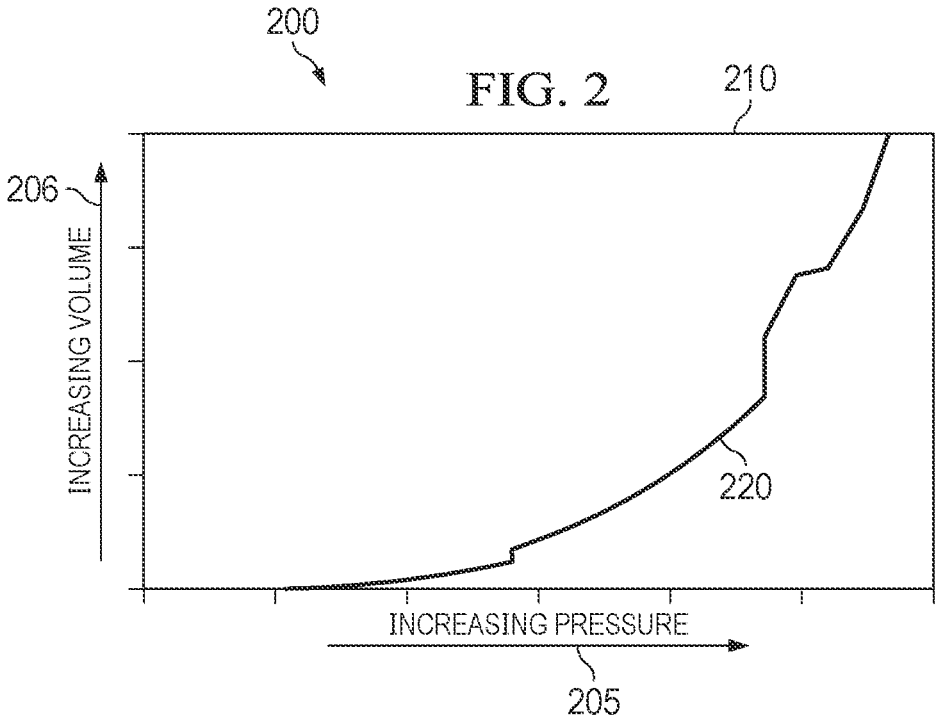
FIG. 2 is an illustration of a diagram of an example fluid volume graph for an adjacent borehole.

FIG. 2 is an illustration of a diagram of an example fluid volume graph 200 for an adjacent borehole. Fluid volume graph 200, generated from data collected from an adjacent borehole, can be utilized as a pressure-volume model. Fluid volume graph 200 has an x-axis 205 showing an increasing pressure. A y-axis 206 shows an increasing volume of fluid. A plot area 210 shows line plot 220 of an adjacent borehole showing the pressure-volume curve.

Figure 3:
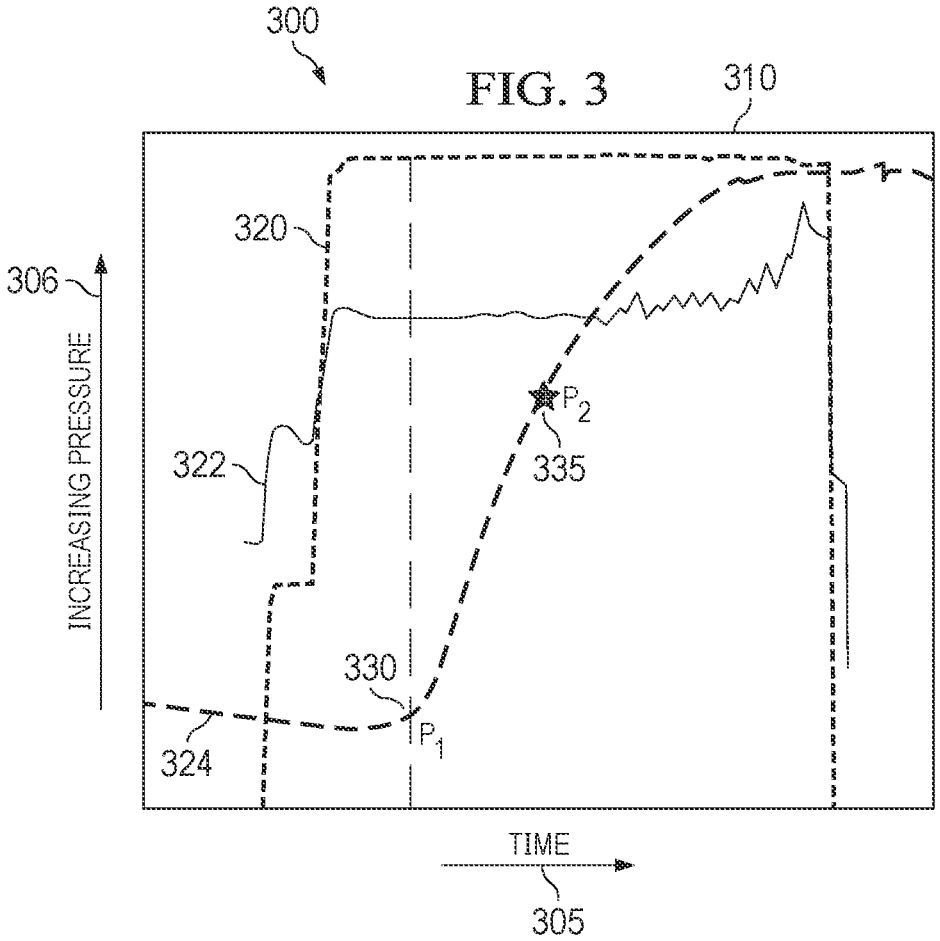
FIG. 3 is an illustration of a diagram of an example graph to monitor adjacent borehole pressure changes.

FIG. 3 is an illustration of a diagram of an example graph 300 to monitor adjacent borehole pressure changes as fluid is pumped into the active borehole. As the pumped fluid is pumped into the active borehole over time, changes can be measured for the pressure of the fluid in the active borehole and the adjacent borehole. Graph 300 has an x-axis 305 showing time, and a y-axis 306 showing increasing pressure. A plot area 310 has three line plots and event points.

A line plot 320 shows an example pumped fluid flow rate over time. A line plot 322 shows an example pumped fluid pressure changing over time. A line plot 324 shows an example pressure rate measured in an adjacent borehole. Point $P_1$ 330 indicates a point where the pressure in the adjacent borehole begins to increase at a higher rate than at a previous point in time. The increased rate of pressure can be indicative of a leak-off event. Point $P_2$ 335 indicates an arbitrary point after point $P_1$ 330. The input parameters gathered at point $P_1$ 330 and point $P_2$ 335 can be utilized by the methods described in FIG. 5.

Figure 4:
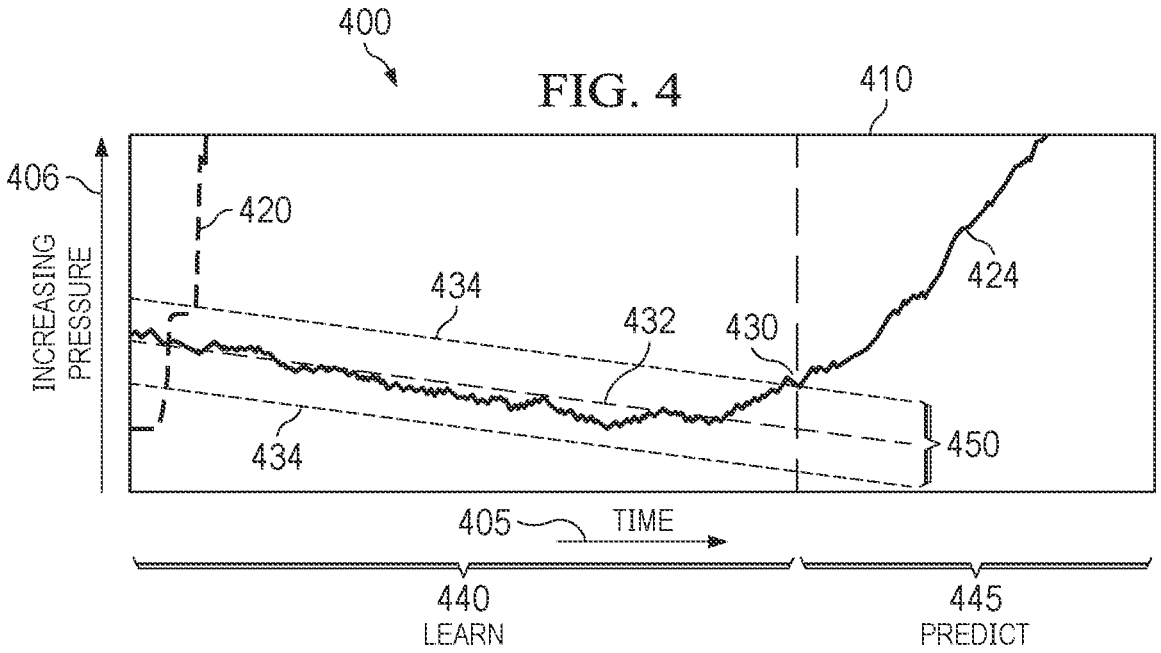
FIG. 4 is an illustration of a diagram of an example graph to predict a leak-off event.

FIG. 4 is an illustration of a diagram of an example graph 400 to predict a leak-off event using machine learning algorithms. Graph 400 can be generated using input parameters received from an adjacent borehole in real-time or near real-time, or from a data storage, for example, a hard disk, database, memory, cloud environment, or other storage areas. Graph 400 has an x-axis 405 showing increasing time and a y-axis 406 showing increasing pressure. A plot area 410 shows line plots similar to graph 300 of FIG. 3, with a focus on the bottom portion of graph 300.

A line plot 420 is a portion of a pumped fluid rate line, similar to line plot 320. A line plot 424 is a portion of line plot 324 from graph 300, with a focus around a point 430, similar to point $P_1$ 330. The left side of point 430, shown by the vertical dashed line, represents a learn 440 portion of the analysis. The right side of point 430 represents a predict 445 portion of the analysis.

The machine learning algorithm can utilize the received information to perform analysis in support of the processes described herein. A fitted line 432 can be fitted to line plot 424 in learn 440 portion. A fracture hit threshold can be utilized to determine a range of values that can satisfy fitted line 432, this calculated range is shown by threshold lines 434 in learn 440 portion. In predict 445 portion, fitted line 432 and threshold lines 434 are estimated as shown by prediction 450. Point 430 is the point where line plot 424 no longer satisfies the fracture hit threshold, therefore a leak-off event is likely occurring and should be analyzed more closely by a computing system or a user.

FIGS. 2, 3, and 4 demonstrate graphs that can be utilized to assist in the disclosed analysis and processes. These graphs are for demonstration purposes and are not necessary for the implementation of the disclosed processes. The disclosed processes can be implemented within a computing system where the input parameters are stored and manipulated in a form appropriate for the computing system without a graphing or visual component.

Figure 5:
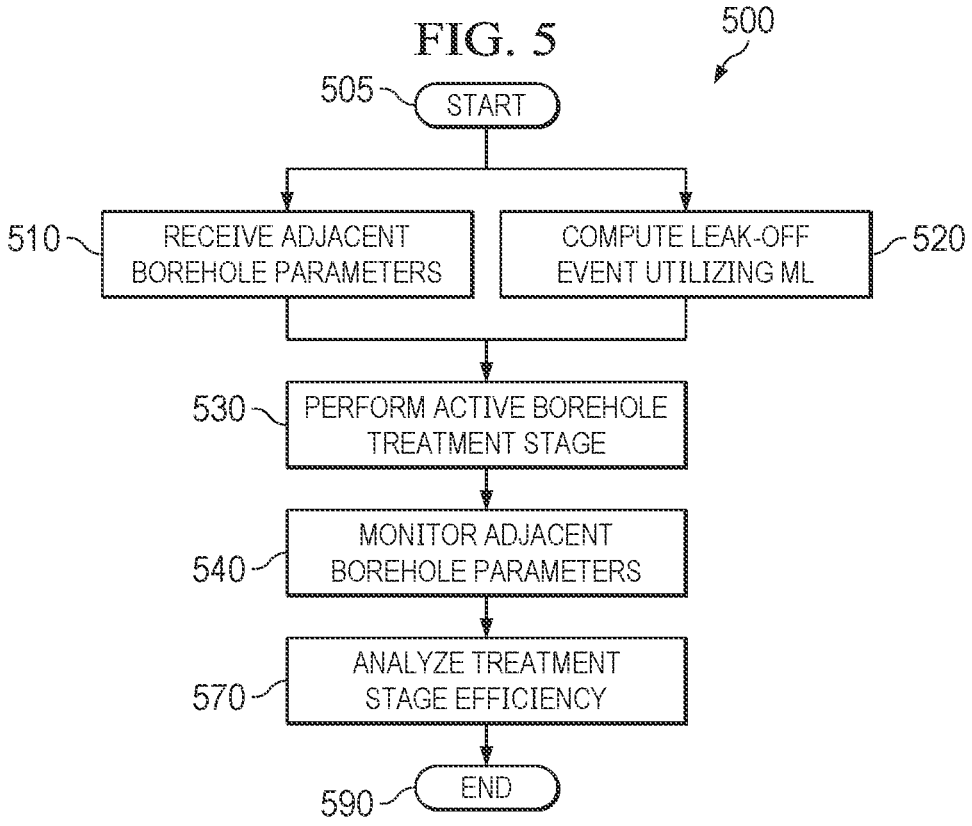
FIG. 5 is an illustration of a flow diagram of an example method to monitor an adjacent borehole for a leak-off event.

FIG. 5 is an illustration of a flow diagram of an example method 500 to monitor an adjacent borehole system for a leak-off event. Method 500 can be performed on a computing system, such as a well site controller, a leak-off event estimator, or other computing system capable of receiving the input parameters, and capable of communicating with equipment or a user at a well site, for example, well site controller 630 of FIG. 6. Other computing systems can be a smartphone, a mobile phone, a PDA, a laptop computer, a desktop computer, a server, a data center, a cloud environment, or other computing system. Method 500 can be encapsulated in software code or in hardware, for example, an application, a code library, a dynamic link library, a module, a function, a RAM, a ROM, and other software and hardware implementations. The software can be stored in a file, database, or other computing system storage mechanism. Method 500 can be partially implemented in software and partially in hardware.

Method 500 starts at a step 505 and proceeds to a step 510 or a step 520. Step 510 can be selected when input parameters from the adjacent borehole system are available. Step 520 can be selected when input parameters from the adjacent borehole system are not available and a machine learning process can be utilized. When step 510 is selected, the processes can receive adjacent borehole system input parameters. There can be one or more adjacent borehole systems utilized in the processes. In some aspects, the adjacent borehole system input parameters can be the water-injection data or re-fracture data for the adjacent borehole systems. In some aspects, the adjacent borehole system input parameters can correspond to pressure and flow-rate recording over the time interval of interest. Using the flow-rate time-series data, the volume injected can be computed and, in some aspects, a fluid pressure vs. fluid volume chart can be generated. In some aspects, the fluid pressure can be translated to bottom-hole conditions by applying the appropriate vertical depth parameter. An example of the fluid pressure vs. fluid volume curve is shown in FIG. 2. In some aspects, the data utilized to generate the fluid pressure vs. fluid volume curve can be utilized as a look-up table to obtain a volume of the fluid for a given fluid pressure in the borehole.

In some aspects, the fluid pressure vs. fluid volume data can be utilized to infer borehole and reservoir specific characteristics, for example, a system compressibility parameter ($C_p$), a leak-off coefficient ($L_k$), and a time shift factor (to) by fitting Equation 1 to the data. The fluid volume in the borehole for a given fluid pressure at a given time can be computed utilizing these estimated coefficients.

Equation 1: Example Calculating Fluid Volume Using Estimated Borehole Characteristic Coefficients $$\Delta V = C_p(P_p - P,s) - 2L_k(\sqrt{t+t_0} - \sqrt{t_s+t_0})$$

where ΔV is the calculated fluid volume, $C_p$ is the system compressibility parameter utilizing the initial fluid pressure $P_p$,s and a measured point in time (t) pressure $P_p$, and $L_k$ is the leak-off coefficient over a time interval identified by a start time $t_s$, a time shift factor $t_0$, and the point in time t.

When step 520 is selected, a machine learning process can be utilized to predict the fluid pressure vs. fluid volume data or to predict the fitted coefficients. For example, one such process can be to collect production data for all adjacent borehole systems that have fluid injection data. This can be represented as a time history of the production volume for gas ($Q_g$), oil ($Q_o$), and water ($Q_w$). The production volume can be converted to bottom hole production conditions utilizing a formation factor as shown in Equation 2.

Equation 2: Example Bottom Hole Production Conversion $$Q_p = Q_o f_o + Q_g f_g + Q_w$$

where $Q_p$ is the computed production volume that can be utilized as the input parameters in the subsequent method steps, $f_o$ is the formation oil factor, and $f_g$ is the formation gas factor.

The production flow rate can be computed utilizing Equation 3. A general fit can be computed where time (x-axis) and inverse flow rate (y-axis) can be utilized to determine the slope (m) and intercept (c). For example, Equation 4 demonstrates a linear fit and the x-axis is a square root of time.

Equation 3: Example Production Flow Rate $$q_p = dQ_p/dt$$

Equation 4: Example Linear Fit $$1/q_p = m\sqrt{t} + c$$

A machine learning model can utilize the computed $Q_p$, m, and c factors along with corresponding injection data. In some aspects, additional factors can be included in the machine learning model. For one or more of the adjacent borehole systems that do not have corresponding input parameters, the machine learning model can be used to estimate the input parameters for those respective adjacent borehole systems.

From step 510 or step 520, method 500 proceeds to a step 530, where the active borehole treatment stage can be in progress, such as pumping a fluid into the active borehole. The treatment stage follows the treatment plan and can have various combinations of flow rate, pressure, and composition changes over the time interval of the treatment stage. Proceeding to a step 540, the processes can monitor the input parameters from one or more adjacent borehole systems as the treatment stage is in progress. The monitoring can receive or determine a fracture hit threshold that can be utilized to determine when a pressure change in an adjacent borehole system is sufficient to trigger further analysis for a potential leak-off event. The further analysis can include calculating volume changes compared to the expected volume change, for example, using Equation 1.

FIG. 3 can be used to demonstrate an example analysis. Pressure point $P_1$ 330 ($P_1$) corresponds to the fluid pressure at the fracture hit event and pressure point $P_2$ 335 ($P_2$) is a fluid pressure at a later time during the treatment stage. The fluid volume leaking off to the adjacent borehole system, e.g., a void, a depleted reservoir, or an adjacent borehole, can be determined using the function shown in Equation 5. If a look-up table approach can be utilized, then Equation 6 can be used to calculate the adjacent borehole volume. If the coefficients of the fluid pressure vs. fluid volume curve are utilized as shown in Equation 1, then for this example, Equation 7 can be utilized. The volume of pumped fluid lost to the void represents the severity of the interference. In some aspects, a control action such as adjusting the pumping rate, adjusting the composition, or dropping diverters can be deployed if this value does not satisfy a fracture hit threshold.

Equation 5: Example Adjacent Borehole Volume Function $$\Delta V = f(P_1, t_1, P2, t_2)$$

Equation 6: Example Adjacent Borehole Volume Using a Look Table $$\Delta V = V(P_2) - V(P_1)$$

Equation 7: Example Adjacent Borehole Volume Using Equation 1 Coefficients $$\Delta V = C_p(P_2 - P_1) - 2L_k(\sqrt{t_2 + t_0} - \sqrt{t_1 + t_0})$$

The fracture hit event detected at $P_z$ can be determined by an algorithm. For example, graph 400 in FIG. 4 can be utilized to demonstrate one potential algorithm. Input parameters from adjacent boreholes can be received over an initial time interval, for example, ten minutes or other time intervals. In some aspects, the time interval can start at the start of the active borehole treatment stage. In some aspects, the time interval can start prior to or after the start of the treatment stage.

The input parameters can be used in correspondence to the pumped fluid pressure and pumped fluid flow rate, such as shown in FIG. 3 and FIG. 4. A curve fit, e.g., general fit, operation can be applied starting at the to time period. This is represented by fitted line 432 in FIG. 4 and is shown by example using a linear fit in Equation 8, such that the error represented by Equation 9 is minimized.

Equation 8: Example Linear Line Fit $$\bar{p} = bt + c$$

Equation 9: Example Error Minimization $$\Sigma(\tilde{p}(t_i) - p(t_i))^2$$

where $\tilde{p}(t_i)$ is the linear fit to the data received at $p(t_i)$;

b is the slope; and c is the intercept.

In some aspects, the fracture hit threshold can be determined by an input parameter, for example, provided by a user or a computing system, such as a well site controller. In some aspects, the fracture hit threshold can be determined using a confidence interval on the fit, for example, a standard deviation as shown in Equation 10.

Example standard deviation for determining a confidence interval $$\sigma = \sqrt{\frac{\sum(\bar{p}(t_i) - p(t_i))^2}{N - 1}} \qquad \text{Equation 10}$$

where N is the number of samples in the learn 440 portion. In some aspects, the fracture hit threshold can be defined as $\tilde{p} \pm c\sigma$ where c represents a multiplier. In some aspects, the multiplier can be 2.5 to 3.0, and in other aspects, other values can be used. Threshold lines 434 represent the determined fracture hit threshold as applied to the received input parameters.

The curve fit and the fracture hit threshold can be extended into the predict 445 portion by setting the time variable t in the regression fit. If the regression fit in the predict 445 portion satisfies the fracture hit threshold then that time interval can be moved into the learn 440 portion and a new predict 445 portion can be estimated by increasing the time variable t. The analysis can be performed again using the new time interval and the received input parameters corresponding to the new time interval.

If the regression fit in the predict 445 portion does not satisfy the fracture hit threshold then a potential leak-off event can be detected at the time where the regression fit fails, for example, point 430. To determine whether the potential leak-off event is a true leak-off event, additional analysis can be applied.

In some aspects, a leak-off linear regression can be fit to the data in the predict 445 portion. If the slope suggests an overall increase of pressure, then the potential event can be assumed as a leak-off event. In some aspects, the potential event detection can utilize an estimation of pumped fluid entering the adjacent borehole. If the amount of pumped fluid entering the adjacent borehole after the time of the potential event exceeds a leak-off threshold, then the potential event can be assumed a leak-off event. The leak-off threshold can be part of the input parameters received or can be defaulted to a pre-determine parameter.

Once the leak-off event is detected, an appropriate control technique can be performed to mitigate the leak-off event. The pressure reading past the leak-off event detection point, for example point 430, in correspondence to the volume of the pumped fluid estimated to have flowed into the adjacent borehole, can be utilized to assess the effect of the control strategy.

Proceeding to a step 570, the treatment stage efficiency can be analyzed and adjustments can be determined. In some aspects, the adjustments can be a change to the pumped fluid pressure, pumped fluid flow rate, or pumped fluid volume. In some aspects, the adjustments can be a change in the pumped fluid composition, an addition or subtraction of added material such as diverter material, or other compositional changes. As the adjustments are implemented in the treatment stage, the processes as described herein can be performed in real-time, near real-time, or at proscribed time intervals to update the leak-off event data. Further adjustments can be made as needed. The adjustments can be implemented by a borehole device, such as a well site controller, or by a user. Method 500 ends at a step 590.

Figure 6:
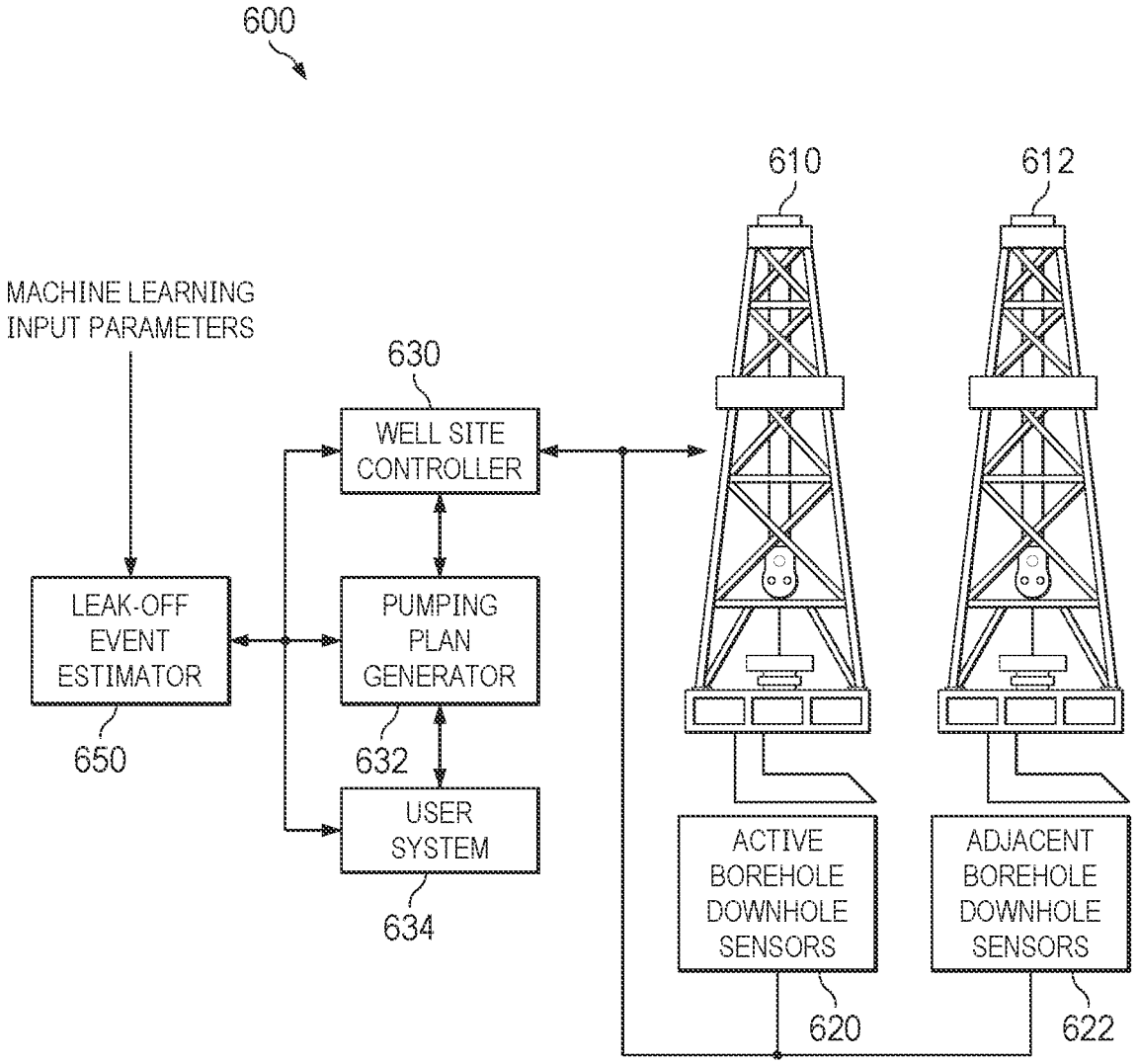
FIG. 6 is an illustration of a block diagram of an example leak-off estimator system.

FIG. 6 is an illustration of a block diagram of an example leak-off estimator system 600, which can be implemented using a pumping system and one or more computing systems, for example, a well site controller, a reservoir controller, a data center, a cloud environment, a server, a laptop, a smartphone, a mobile phone, a tablet, and other computing systems. The computing system can be located proximate the well site, or a distance from the well site, such as in a data center, cloud environment, or corporate location. The computing system can be a distributed system having a portion located proximate the well site and a portion located remotely from the well site.

Leak-off estimator system 600, or a portion thereof, can be implemented as an application, a code library, a dynamic link library, a function, a module, other software implementation, or combinations thereof. In some aspects, leak-off estimator system 600 can be implemented in hardware, such as a ROM, a graphics processing unit, or other hardware implementation. In some aspects, leak-off estimator system 600 can be implemented partially as a software application and partially as a hardware implementation.

Leak-off estimator system 600 includes an active borehole system 610 with downhole sensors 620, such as fluid pressure and temperature sensors, an adjacent borehole system 612 with downhole sensors 622, such as fluid pressure and temperature sensors. There can be additional adjacent borehole systems. Active borehole system 610 also includes a pumping system capable of pumping a fluid with or without additional material, such as chemicals, additives, diverter material, and other downhole material, downhole into the borehole. Communicatively coupled to active borehole system 610 and, optionally, adjacent borehole system 612, is one or more well site controllers 630. In some aspects, a pumping plan generator 632 is communicatively coupled to well site controllers 630. In some aspects, pumping plan generator 632 is part of well site controllers 630. A user system 634 is communicatively coupled to well site controllers 630 and pumping plan generator 632 to allow users to enter the input parameters, view analysis, and be able to direct adjustments to a treatment stage of active borehole system 610.

A leak-off event estimator 650 is communicatively coupled to well site controllers 630, pumping plan generator 632, and user system 634. Leak-off event estimator 650 is capable of receiving input parameters from one or more sources, for example, from a machine learning model, from downhole sensors 622, from well site controllers 630, from user system 634, or from other systems associated with the active borehole system 610. Leak-off event estimator 650 can perform the analysis, processes, and methods as described herein to determine a leak-off event, and to provide the leak-off event data to pumping plan generator 632, well site controllers 630, or user system 634.

The leak-off event data can be utilized by a user to adjust a treatment plan, or by pumping plan generator 632 to adjust a treatment plan which can be implemented by other systems. The receipt of input parameters and the subsequent analysis and processes can be performed in real-time, near-real-time, or at a periodic time interval to allow updated leak-off event data to be analyzed as a treatment stage is in progress at active borehole system 610.

In some aspects, leak-off event estimator 650 can be part of well site controllers 630. In some aspects, leak-off event estimator 650 can be part of pumping plan generator 632. In some aspects, leak-off event estimator 650 can communicate with other systems, for example, a data center, cloud environment, or other computing systems to provide the leak-off event data. In some aspects, leak-off event estimator 650 can generate visual graphs. In some aspects, leak-off event estimator 650 can provide the leak-off event data to another system for decision making and processing.

A memory or data storage of leak-off event estimator 650 can be configured to store the processes and algorithms for directing the operation of leak-off event estimator 650. Leak-off event estimator 650 can include a processor that is configured to operate according to the analysis operations and algorithms disclosed herein, and an interface to communicate (transmit and receive) data.

A portion of the above-described apparatus, systems or methods may be embodied in or performed by various analog or digital data processors, wherein the processors are programmed or store executable programs of sequences of software instructions to perform one or more of the steps of the methods. A processor may be, for example, a programmable logic device such as a programmable array logic (PAL), a generic array logic (GAL), a field programmable gate arrays (FPGA), or another type of computer processing device (CPD). The software instructions of such programs may represent algorithms and be encoded in machine-executable form on non-transitory digital data storage media, e.g., magnetic or optical disks, random-access memory (RAM), magnetic hard disks, flash memories, and/or read-only memory (ROM), to enable various types of digital data processors or computers to perform one, multiple or all of the steps of one or more of the above-described methods, or functions, systems or apparatuses described herein.

Portions of disclosed examples or embodiments may relate to computer storage products with a non-transitory computer-readable medium that have program code thereon for performing various computer-implemented operations that embody a part of an apparatus, device or carry out the steps of a method set forth herein. Non-transitory used herein refers to all computer-readable media except for transitory, propagating signals. Examples of non-transitory computer-readable media include, but are not limited to: magnetic media such as hard disks, floppy disks, and magnetic tape; optical media such as CD-ROM disks; magneto-optical media such as floppy disks; and hardware devices that are specially configured to store and execute program code, such as ROM and RAM devices. Examples of program code include both machine code, such as produced by a compiler, and files containing higher level code that may be executed by the computer using an interpreter.

In interpreting the disclosure, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced.

Those skilled in the art to which this application relates will appreciate that other and further additions, deletions, substitutions and modifications may be made to the described embodiments. It is also to be understood that the terminology used herein is for the purpose of describing particular embodiments only, and is not intended to be limiting, because the scope of the present disclosure will be limited only by the claims. Unless defined otherwise, all technical and scientific terms used herein have the same meaning as commonly understood by one of ordinary skill in the art to which this disclosure belongs. Although any methods and materials similar or equivalent to those described herein can also be used in the practice or testing of the present disclosure, a limited number of the exemplary methods and materials are described herein.

Each of the aspects as disclosed in the SUMMARY section can have one or more of the following additional elements in combination. Element 1: adjusting the treatment stage by adjusting one or more of a pumped fluid volume, a pumped fluid flow rate, a pumped fluid pressure, or a pumped fluid composition. Element 2: wherein the pumped fluid composition can be adjusted by one or more of increasing or decreasing one or more of an oil, a water, a brine, a slurry, a proppant, a chemical, an additive, or a diverter material. Element 3: wherein the input parameters are received at the periodic time interval from one or more sensors in the one or more adjacent boreholes, wherein the input parameters can include the adjacent fluid volume and the adjacent fluid pressure relationship over a recording time interval. Element 4: wherein the input parameters are utilized as a look up table to obtain the adjacent fluid volume from the adjacent fluid pressure. Element 5: wherein the adjacent fluid volume at a specified time and specified fluid pressure is computed utilizing a system compressibility parameter, a leak-off coefficient, and a time shift factor. Element 6: wherein the adjacent fluid volume at a specified time and specified fluid pressure is computed utilizing a machine learning model trained using an estimate of a production volume of an oil, a gas, and a water for the one or more adjacent boreholes. Element 7: wherein the fracture hit threshold is determined from a standard deviation and a multiplier. Element 8: a pumping plan generator, capable of adjusting the at least one treatment stage and communicating with the well site controller. Element 9: a machine learning model, capable of estimating a fluid volume utilizing a production volume of oil, a production volume of water, and a production volume of gas from the at least one adjacent borehole. Element 10: a sensor, capable of communicating a measured fluid pressure as an input parameter to the leak-off event estimator, wherein the sensor measures fluid pressure in the at least one adjacent borehole. Element 11: wherein the treatment stage is adjusted utilizing an output of the leak-off event estimator, where the treatment stage adjusts a pumped fluid volume, a pumped fluid flow rate, a pumped fluid pressure, or a pumped fluid composition. Element 12: wherein the periodic time interval is real-time or near real-time. Element 13: adjusting the treatment stage by directing one or more of a pumped fluid volume, a pumped fluid flow rate, a pumped fluid pressure, or a pumped fluid composition.

What is claimed is:

1. A method, comprising:

receiving input parameters from one or more adjacent boreholes in a reservoir;

performing a treatment stage of an active borehole proximate the one or more adjacent boreholes;

monitoring the input parameters of the one or more adjacent boreholes, wherein the input parameters are received at a periodic time interval; and determining a leak-off event by monitoring a change in one or more of an adjacent fluid pressure and an adjacent fluid volume of the one or more adjacent boreholes, wherein the adjacent fluid pressure exceeds a fracture hit threshold or the adjacent fluid volume exceeds a leak-off threshold, where the fracture hit threshold is determined from a standard deviation and a multiplier.

2. The method as recited in claim 1, further comprising:

adjusting the treatment stage by adjusting one or more of a pumped fluid volume, a pumped fluid flow rate, a pumped fluid pressure, or a pumped fluid composition.

3. The method as recited in claim 2, wherein the pumped fluid composition is adjusted by one or more of increasing or decreasing one or more of an oil, a water, a brine, a slurry, a proppant, a chemical, an additive, or a diverter material.

4. The method as recited in claim 1, wherein the input parameters are received at the periodic time interval from one or more sensors in the one or more adjacent boreholes, wherein the input parameters include the adjacent fluid volume and the adjacent fluid pressure relationship over a recording time interval.

5. The method as recited in claim 4, wherein the input parameters are utilized as a look up table to obtain the adjacent fluid volume from the adjacent fluid pressure.

6. The method as recited in claim 4, wherein the adjacent fluid volume at a specified time and specified fluid pressure is computed utilizing a system compressibility parameter, a leak-off coefficient, and a time shift factor.

7. The method as recited in claim 1, wherein the adjacent fluid volume at a specified time and specified fluid pressure is computed utilizing a machine learning model trained using an estimate of a production volume of an oil, a gas, and a water for the one or more adjacent boreholes.

8. The method as recited in claim 1, wherein the leak-off event is utilized by a well site controller or a pumping plan generator to modify the treatment stage.

9. A system that includes an active borehole of a reservoir undergoing at least one treatment stage where pumped fluid is pumped into the active borehole, the system comprising:

a well site controller, capable of directing operation of the active borehole and directing an adjustment of the pumped fluid, and where the reservoir includes at least one adjacent borehole; and a leak-off event estimator, capable of receiving input parameters from the at least one adjacent borehole and the well site controller at a periodic time interval, and determining a leak-off event, wherein the leak-off event is determined using a fracture hit threshold or a leak-off threshold, where the input parameters include at least one adjacent fluid pressure and at least one adjacent fluid volume, wherein the fracture hit threshold is determined from a standard deviation and a multiplier.

10. The system as recited in claim 9, further comprising:

a pumping plan generator, capable of adjusting the at least one treatment stage and communicating with the well site controller.

11. The system as recited in claim 9, further comprising:

a machine learning model, capable of estimating a fluid volume utilizing a production volume of oil, a production volume of water, and a production volume of gas from the at least one adjacent borehole.

12. The system as recited in claim 9, further comprising:

a sensor, capable of communicating a measured fluid pressure as an input parameter to the leak-off event estimator, wherein the sensor measures fluid pressure in the at least one adjacent borehole.

13. The system as recited in claim 9, wherein the treatment stage is adjusted utilizing an output of the leak-off event estimator, where the treatment stage adjusts a pumped fluid volume, a pumped fluid flow rate, a pumped fluid pressure, or a pumped fluid composition.

14. The system as recited in claim 9, wherein the periodic time interval is real-time or near real-time.

15. A computer program product having a series of operating instructions stored on a non-transitory computer-readable medium that directs a data processing apparatus when executed thereby to perform operations to determine a leak-off event, the operations comprising:

receiving input parameters from one or more adjacent boreholes in a reservoir;

directing a treatment stage of an active borehole proximate the one or more adjacent boreholes;

monitoring the input parameters of the one or more adjacent boreholes, wherein the input parameters are received at a periodic time interval;

determining a leak-off event by monitoring a change in one or more of an adjacent fluid pressure and an adjacent fluid volume of the one or more adjacent boreholes, wherein the adjacent fluid pressure exceeds a fracture hit threshold or the adjacent fluid volume exceeds a leak-off threshold, where the fracture hit threshold is determined from a standard deviation and a multiplier; and performing the treatment stage by directing a well site controller by utilizing the leak-off event.

16. The computer program product as recited in claim 15, wherein the well site controller adjusts one or more of a pumped fluid volume, a pumped fluid flow rate, a pumped fluid pressure, or a pumped fluid composition, of the treatment stage.

17. The computer program product as recited in claim 15, wherein the input parameters are received at the periodic time interval from one or more sensors in the one or more adjacent boreholes, wherein the input parameters include the adjacent fluid volume and the adjacent fluid pressure relationship over a recording time interval.

18. The computer program product as recited in claim 17, wherein the adjacent fluid volume at a specified time and specified adjacent fluid pressure is computed utilizing a system compressibility parameter, a leak-off coefficient, and a time shift factor.

19. The computer program product as recited in claim 15, wherein the adjacent fluid volume at a specified time and specified adjacent fluid pressure is computed utilizing a machine learning model trained using an estimate of a production volume of an oil, a production volume of a gas, and a production volume of a water for the one or more adjacent boreholes.

20. The computer program product as recited in claim 15, wherein the leak-off event is communicated to the well site controller or a pumping plan generator to modify the treatment stage.

* * * * *